US006601793B2

(12) United States Patent
Yasui et al.

(10) Patent No.: US 6,601,793 B2
(45) Date of Patent: Aug. 5, 2003

(54) FILAMENT WINDING APPARATUS AND YARN END PROCESSING METHOD FOR THE APPARATUS

(75) Inventors: Yoshiharu Yasui, Kariya (JP); Yasuki Miyashita, Kariya (JP); Masaaki Amano, Kariya (JP)

(73) Assignee: Kabushiki Kaisha Toyoda Jidoshokki Seisakusho, Kariya (JP)

( * ) Notice: Subject to any disclaimer, the term of this patent is extended or adjusted under 35 U.S.C. 154(b) by 147 days.

(21) Appl. No.: 09/816,009

(22) Filed: Mar. 23, 2001

(65) Prior Publication Data

US 2001/0028015 A1 Oct. 11, 2001

(30) Foreign Application Priority Data

Mar. 30, 2000 (JP) ..... 2000-094007

(51) Int. Cl.[7] ..... B65H 54/02; B65H 65/00; B65H 54/71

(52) U.S. Cl. ..... 242/472.8; 242/444; 242/476.2; 242/476.6; 242/487.6

(58) Field of Search ..... 242/475.7, 476.2, 242/476.3, 476.6, 487.6, 487.7, 472.8, 444, 445.1; 57/303; 156/173, 175

(56) References Cited

U.S. PATENT DOCUMENTS

| | | | | | |
|---|---|---|---|---|---|
| 2,258,166 | A | * | 10/1941 | Schoelles | 57/131 |
| 2,523,859 | A | * | 9/1950 | Brandish | 242/487.6 |
| 2,827,243 | A | * | 3/1958 | Cadle | 242/476.6 |
| 3,530,657 | A | * | 9/1970 | Grau | 57/303 |
| 4,089,727 | A | * | 5/1978 | McLain | 156/173 |
| 4,288,267 | A | * | 9/1981 | McLarty | 156/175 |
| 4,617,791 | A | * | 10/1986 | Lousberg | 242/475.7 |
| 4,941,314 | A | * | 7/1990 | Odawara | 57/303 |
| 5,211,346 | A | | 5/1993 | Brouwer | |
| 6,085,511 | A | * | 7/2000 | Dinkelmann et al. | 57/135 |
| 6,289,662 | B1 | * | 9/2001 | Dinkelmann et al. | 57/303 |
| 2001/0013563 | A1 | * | 8/2001 | Yasui et al. | 242/444 |

FOREIGN PATENT DOCUMENTS

| | | |
|---|---|---|
| EP | 0 145 878 | 6/1985 |
| FR | 2 624 424 | 6/1989 |
| GB | 1 592 531 | 7/1981 |
| JP | 4-288928 | 10/1992 |
| JP | 7-069539 | 3/1995 |
| JP | 07069539 | 3/1995 |
| JP | 9-256250 | 9/1997 |
| JP | 11-106134 | 4/1999 |

* cited by examiner

*Primary Examiner*—Michael R. Mansen
(74) *Attorney, Agent, or Firm*—Morgan & Finnegan, LLP

(57) ABSTRACT

A filament winding apparatus winds yarn impregnated with resin around the surface of a mandrel with a guide member that moves back and forth axially. Yarn winding is initiated while an end of the yarn is held by a holding device provided in a relatively rotatable manner on a rotary shaft. After winding is started, the yarn extending from the mandrel to the holding device is cut. When winding is finished, the yarn is held with the holding device and the yarn is cut between the mandrel and the holding device with a yarn cutting device.

8 Claims, 11 Drawing Sheets

FILAMENT WINDING APPARATUS AND YARN END PROCESSING METHOD FOR THE APPARATUS

BACKGROUND OF THE INVENTION

The present invention relates to a filament winding apparatus and a yarn end processing method. More particularly, this invention relates to a yarn end process that temporarily fixes the winding-start end of a yarn to be wound around a mandrel and cuts the yarn at a predetermined length with the winding-finishing end of the yarn secured to the mandrel.

A filament winding method efficiently produces FRP (Fiber Reinforced Plastic) pipes or containers. The filament winding method generally uses an apparatus that has a chuck mechanism for holding a portion of a shaft protruding from both ends of the body of a mandrel and rotating the mandrel at a predetermined velocity. A filament feeding mechanism is used to wind a filament (yarn) impregnated with resin around the body of the mandrel. The filament winding apparatus normally requires that the winding-start end and winding-finishing end of a filament be secured manually to the mandrel at a predetermined position. For example, the winding-start end of a filament is securely tied to a pin protruding from the shaft portion or body of the mandrel or the winding-finishing end is secured to the mandrel with adhesive tape.

Japanese Unexamined Patent Publication (KOKAI) No. Hei 7-69539 discloses an apparatus that automatically secures the winding-start end and winding-finishing end of a wire to a mandrel at a predetermined position. This apparatus feeds the winding-start end of a wire to a predetermined position of the mandrel by a wire feeding mechanism and fixes that end to the mandrel using a wire holding device. When winding of the wire on the body of the mandrel is finished, the winding-finishing end of the wire is secured to the body of the mandrel with adhesive tape by an adhesive-tape adhering mechanism.

Because the apparatus disclosed in Japanese Unexamined Patent Publication (KOKAI) No. Hei 7-69539 fixes the winding-start end and the winding-finishing end with different mechanisms, the apparatus is complex and costly. The adhesive tape that is used to fix the winding-finishing end to the mandrel may remain as foreign matter in the final product. This reduces the quality of the product. The use of adhesive tape is inadequate, particularly in the case when the final product is manufactured by winding a high-performance filament (e.g., a carbon fiber) impregnated with a resin around a mandrel and hardening the filament.

The holding device that holds the winding-start end of the filament uses one end face of the mandrel so that the wire is held between the end face of the mandrel and a pressing ring when securing the mandrel to a chuck. This raises a problem that the machine must be stopped when using plural layers of filaments on a mandrel, when using different types of wires (filaments) on a specific layer, when using plural wires on a middle layer, or when using plural wires from a middle of winding.

SUMMARY OF THE INVENTION

Accordingly, it is an object of the present invention to provide a filament winding apparatus and a yarn end processing method in which the winding-start end and winding-finishing end of a filament are fixed to a mandrel or a yarn winding member with the same mechanism, without the possibility of leaving foreign matter such as adhesive tape in the final product.

To achieve the foregoing and other objectives and in accordance with the purpose of the present invention, a yarn end processing method is provided for a filament winding apparatus for winding a yarn around a surface of a mandrel or a yarn winding member. The yarn is wound with a guide member, which moves back and forth in the axial direction of the mandrel or the yarn winding member, while the mandrel or the yarn winding member is supported and rotated. The method comprises:

initiating yarn winding with an end portion of the yarn held by a holding device provided in a relatively rotatable manner on a rotary shaft, which rotates while supporting the mandrel or the yarn winding member;

winding the yarn on the mandrel or the yarn winding member such that, even when a yarn extending from the mandrel or the yarn winding member to the holding device is cut, an end portion of the yarn wound around the mandrel or the yarn winding member will not unwind;

cutting the yarn extending between the mandrel or the yarn winding member and the holding device with a yarn cutting device and releasing the yarn by the holding device before that yarn winding is finished; and performing end winding when winding of the yarn around the mandrel or the yarn winding member is finished;

holding the yarn with the holding section; and cutting the yarn between the mandrel or the yarn winding member and the holding device with the yarn cutting device.

Other aspects and advantages of the invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings in which:

FIG. 2(*b*) is a side view showing the relationship between a yarn guide and a support bracket;

FIG. 3(*b*) is a side view of the cutting device;

FIG. 11(*b*) is a side view of a yarn engagement section according to another modification of the present invention.

DETAILED DESCRIPTION OF THE PREFERRED EMBODIMENTS

A first embodiment of the present invention, which is a general-purpose filament winding apparatus, will now be described referring to FIGS. 1 through 7. When a mandrel rotates, the apparatus winds a resin-impregnated yarn around the surface of the mandrel via a guide member, which moves back and forth in the axial direction of the mandrel.

Figure 2A:
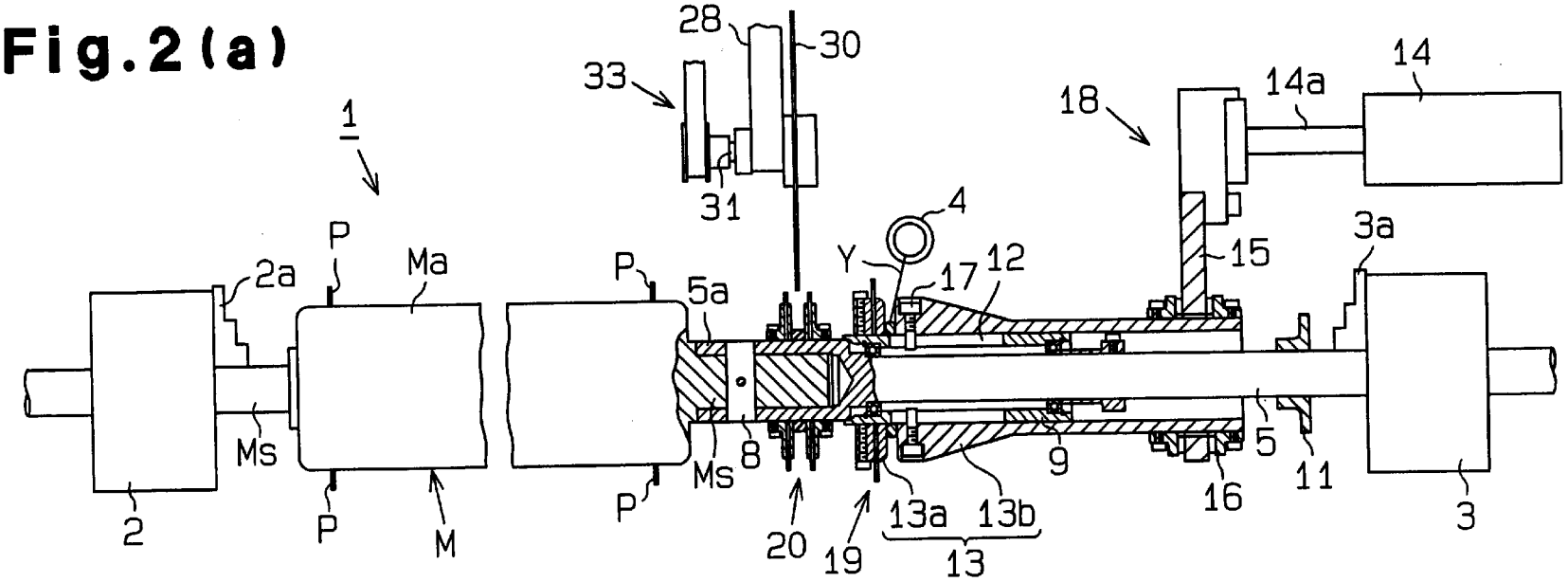
FIG. 2(*a*) is a partly broken-away side view showing the whole apparatus in FIG. 1.
Figure 2B:
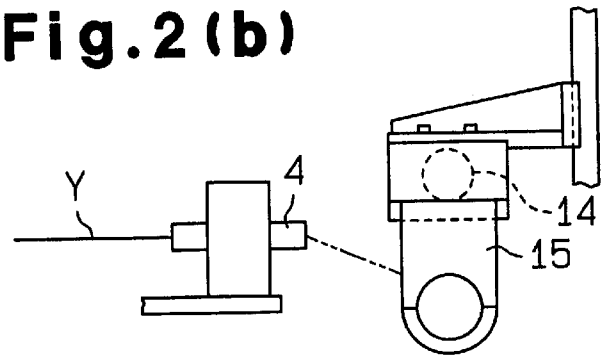

As shown in FIG. 2(*a*), a filament winding apparatus 1 has a first chuck 2, a second chuck 3, a mandrel M, which is supported by the chuck 2 and 3, and a yarn guide 4, which moves back and forth in the axial direction of the mandrel M. The yarn guide 4 is so designed as to be reciprocatable by a feeding mechanism (not shown) which has a ball screw provided parallel to the axis of the chucks 2 and 3. The yarn guide 4 guides a yarn Y, which is fed out from an unillustrated yarn feeding mechanism and is impregnated with a thermosetting resin in a resin tank, to a predetermined position.

Each of the chucks 2 and 3 has plural jaws 2*a* or 3*a* (only one shown in the diagrams). The first chuck 2 holds one of a pair of shaft ends Ms protruding from the respective ends of a body Ma of the mandrel M, and the second chuck 3 holds a rotary shaft 5, which supports the other shaft end Ms. The distance between the chucks 2 and 3 can be adjusted by an unillustrated drive mechanism. Multiple pins P protrude radially from both ends of the body Ma of the mandrel M and are arranged at predetermined angular intervals. The Figures show only two pins P protruding upward and downward.

Figure 1:
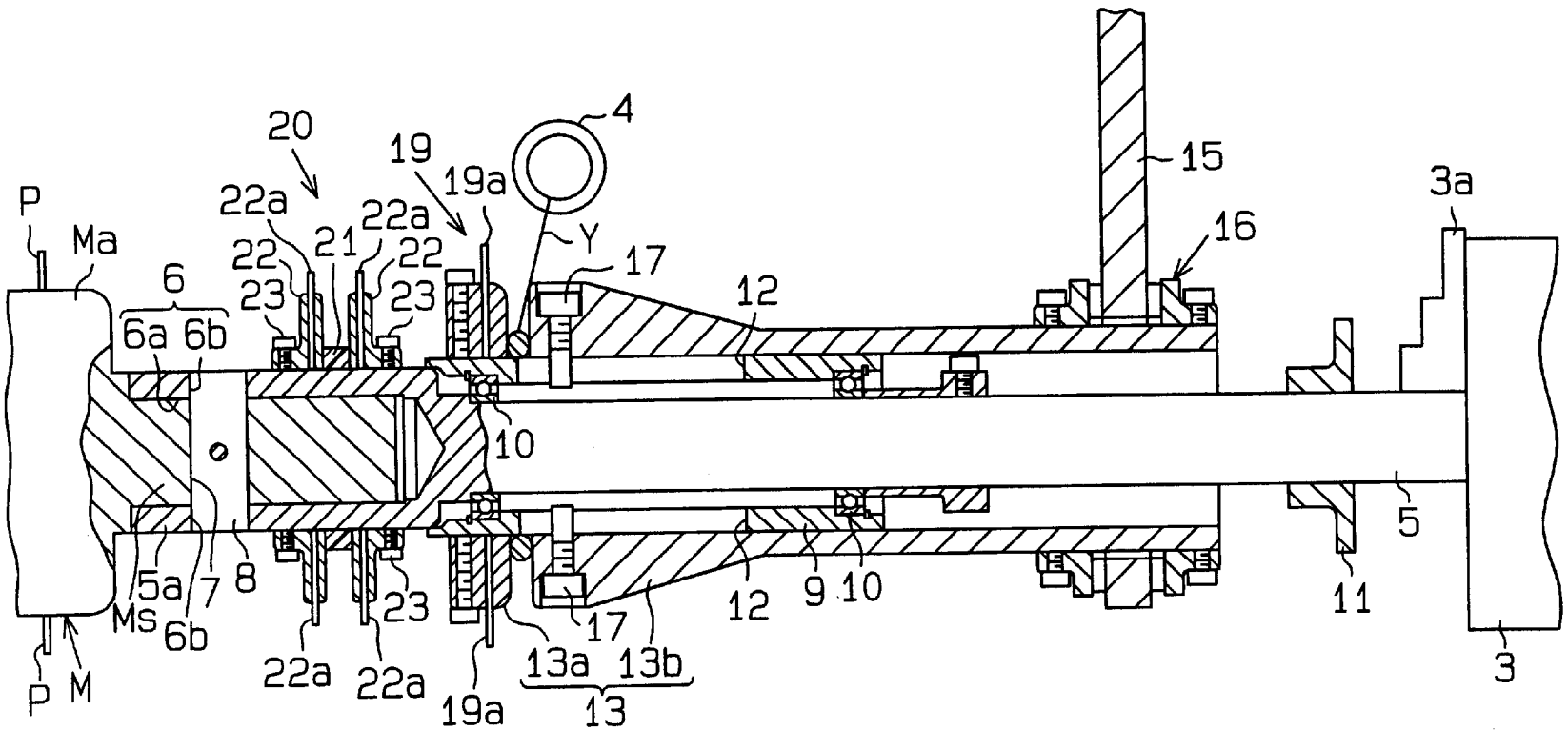
FIG. 1 is a cross-sectional view of essential portions of a filament winding apparatus according to a first embodiment of the present invention.
Figure 4:
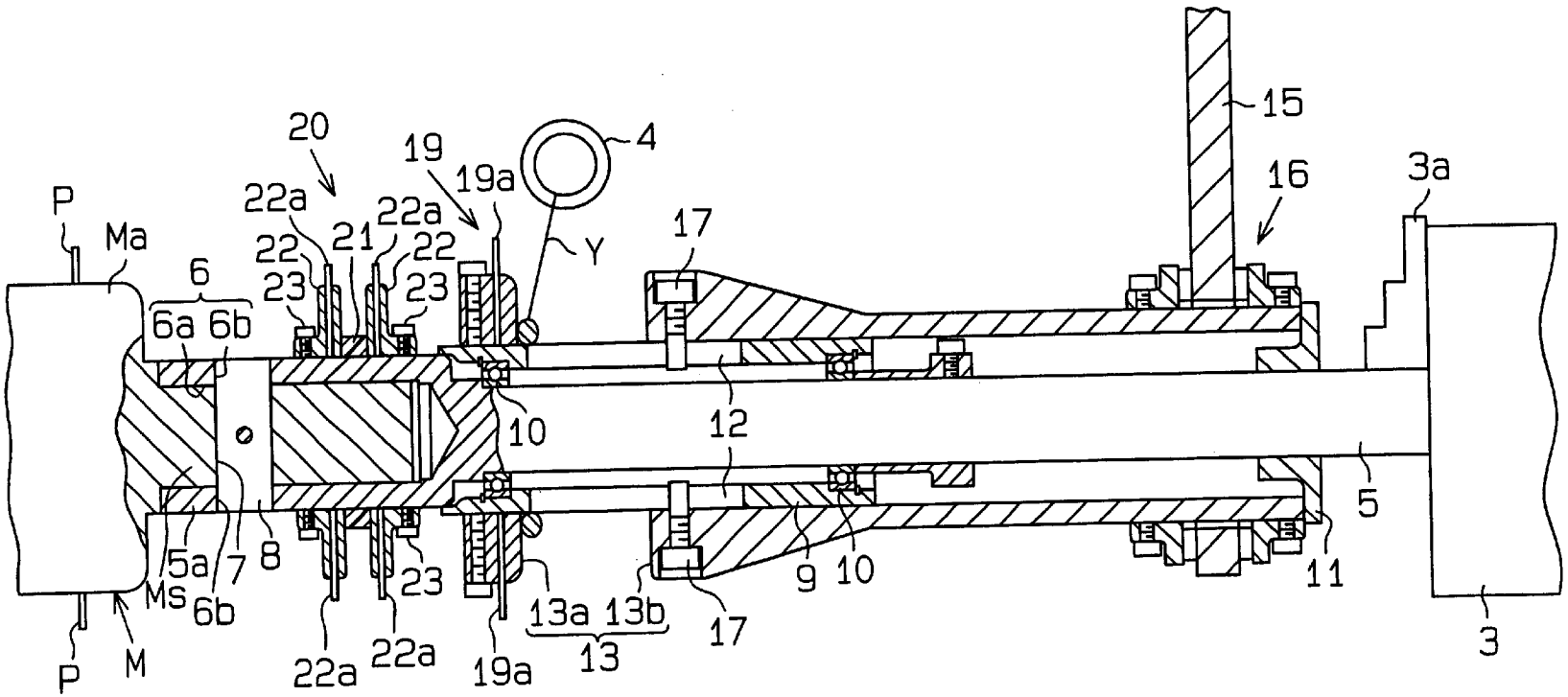
FIG. 4 is a cross-sectional view of essential portions illustrating a movable holding member placed at a release position.
Figure 5A:
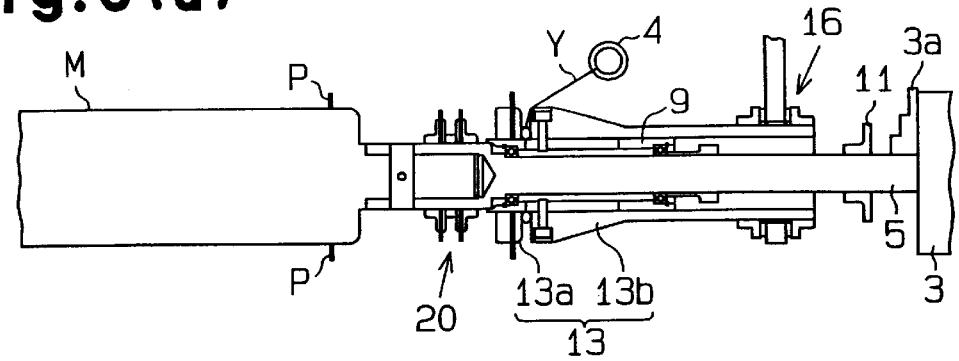
FIGS. 5(*a*) through 5(*d*) are exemplary diagrams for illustrating the operation of the filament winding apparatus.
Figure 5B:
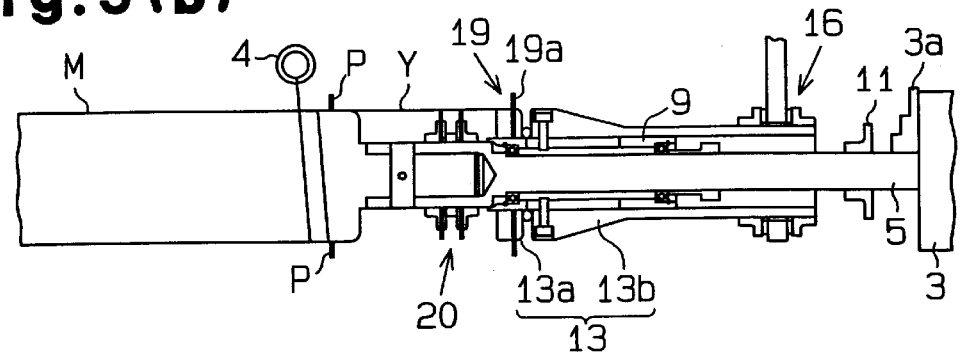
Figure 5C:
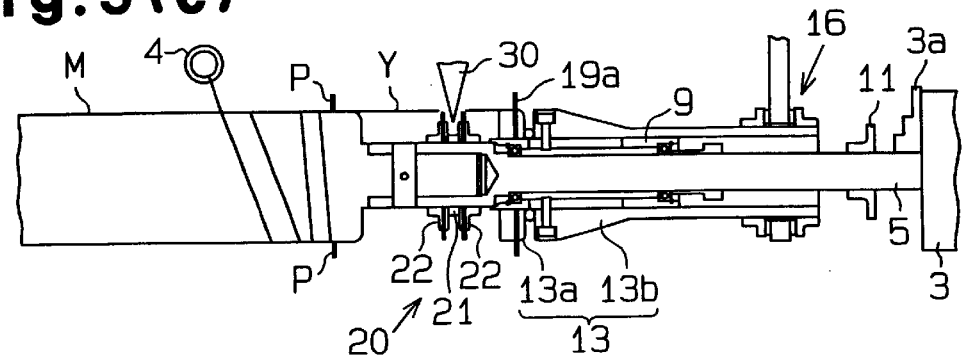
Figure 5D:
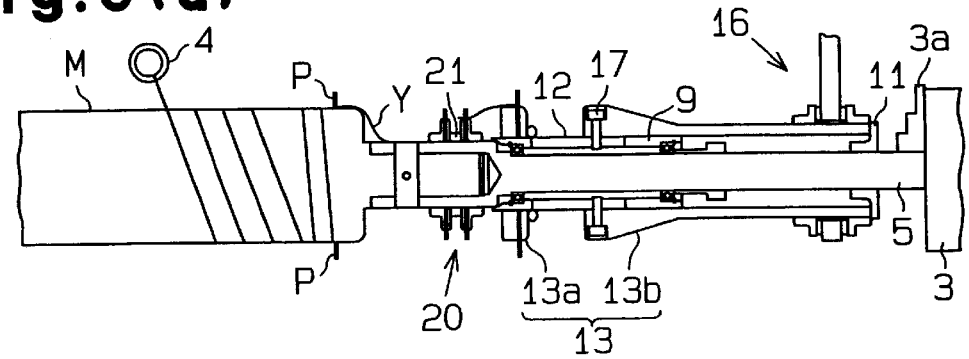

The first end portion of the rotary shaft 5 can be fixed to the second chuck 3, and the second end portion of the rotary shaft 5 has a coupler 6, which couples the associated shaft portion Ms of the mandrel M to the second end portion. As shown in FIGS. 1 and 4, the second end of the rotary shaft 5 includes a large-diameter portion 5*a*. A hole 6*a*, in which the associated shaft end Ms fits, is formed in the center of the large-diameter portion 5*a*. A pair of axially aligned holes 6*b* are located perpendicular to the hole 6*a*. A coupling hole 7, which is perpendicular to the associated shaft end Ms, is bored through the shaft end Ms, and a coupling pin 8 is fitted in the coupling hole 7. The ends of the coupling pin 8 fit in the holes 6*b* to couple the rotary shaft 5 to the mandrel M. The holes 6*a* and 6*b* constitute the coupler 6.

A cylindrical support 9 is supported on the rotary shaft 5 as shown in a relatively rotatable manner via a pair of bearings 10. A rotation transmitting section 11 is fixed to the rotary shaft 5 as shown to rotate with the rotary shaft 5. The rotation transmitting section 11 is disk-like. The support 9 is formed such that its left end, as viewed in FIG. 1, overlaps the right end of the large-diameter portion 5*a*.

A plurality of grooves (elongated holes) 12 (two in this embodiment) are formed in the support 9, and extend in the axial direction. The support 9 is provided with a holding device 13. The holding device 13 has an annular fixed holding member 13*a*, which is fixed to the support 9 as shown. The holding device 13 also includes a movable holding member 13*b*, which is supported on the support 9 and can slide in the axial direction of the support 9. The fixed holding member 13*a* has an outside diameter approximately equal to that of the mandrel M. As shown in FIG. 2(*a*), an air cylinder 14, the axis of which is parallel to the rotary shaft 5, moves the movable holding member 13*b*, which is substantially cylindrical, to a holding position, at which the movable holding member 13*b* together against the fixed holding member 13*a*, and to a release position, which is spaced apart from the holding position in a direction away from the mandrel M.

A support bracket 15 is secured to a piston rod 14*a* of the air cylinder 14. The right end of the movable holding member 13*b* is coupled to the distal end of the support bracket 15 with a thrust bearing 16 in a relatively rotatable manner. When the movable holding member 13*b* is shifted to the release position, its right end is pressed against the rotation transmitting section 11. At this time, the movable holding member 13*b* rotates together with the rotation transmitting section 11. FIG. 2(*b*) shows the positional relationship between the yarn guide 4 and the support bracket 15.

Engagement members 17, which are held to engage with the grooves 12, are provided on the movable holding member 13*b* as shown. The engagement members 17 are bolts that are fastened in screw holes formed in the movable holding member 13*b*. The distal ends of the engagement members 17 protrude into the grooves 12. When the movable holding member 13*b* is moved between the holding position and the release position, the engagement members 17 guide the movable holding member 13*b* such that the movable holding member 13*b* moves along the grooves 12. When the movable holding member 13*b* rotates together with the rotation transmitting section 11, the engagement members 17 serve to transmit torque to the support 9. The fixed holding member 13*a*, the movable holding member 13*b* and the air cylinder 14 constitute a holding mechanism 18.

The fixed holding member 13*a* is provided with a yarn engagement section 19. The yarn engagement section 19 is constructed by multiple pins 19*a* fixed on the fixed holding member 13*a* and radially protruding from the outer surface of the fixed holding member 13*a*. When the movable holding member 13*b* is shifted to the release position, or when the holding device 13 in a release state, the rotary shaft 5 and the rotation transmitting section 11 serve as a drive section for rotating the yarn engagement section 19.

As shown in FIG. 1, for example, the large-diameter portion 5*a* of the rotary shaft 5 is provided with a cut aiding section 20 at a position closer to the mandrel M than the yarn engagement section 19. The cut aiding section 20 has a ring 21 of a synthetic resin and yarn engagement rings 22 secured to sandwich the ring 21. Each yarn engagement ring 22 has an engagement portion 22*a* formed by radially fixed multiple pins and is secured to the large-diameter portion 5*a* by a screw 23 to rotate with the large-diameter portion 5*a*.

Figure 3B:
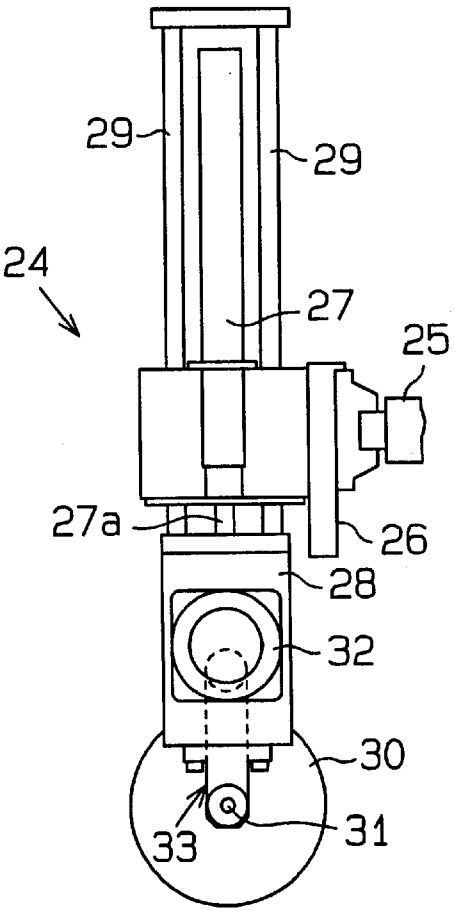
FIG. 3(*a*) is a front view of a cutting device.
Figure 3A:
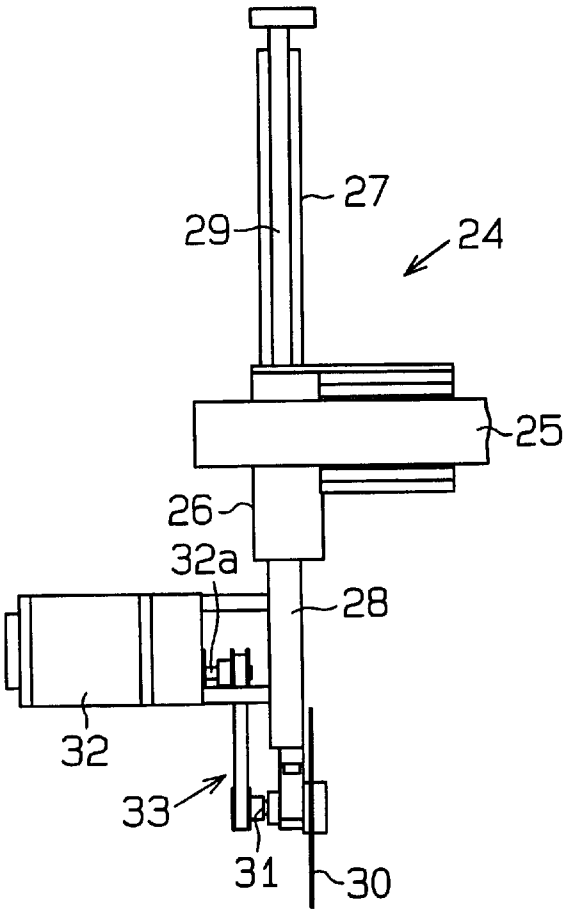

A cutting device 24 is provided above the cut aiding section 20. As shown in FIGS. 3(*a*) and 3(*b*), the cutting device 24 is mounted on a support 26 that is movable along a guide frame 25. An air cylinder 27 is fixed to the support 26 to extend in the vertical direction. A support bracket 28 is secured to the distal end of a piston rod 27*a* of the air cylinder 27. A pair of guide rods 29 that penetrate the support 26 are secured to the support bracket 28. As the air cylinder 27 is actuated, the support bracket 28 is guided by the guide rods 29 to move radially the rotary shaft 5.

A support shaft 31, which supports a disc-shaped rotary cutter 30, is rotatably supported at the bottom end of the support bracket 28 and is parallel to the rotary shaft 5. A drive shaft 32*a* of a motor 32 is parallel to the support shaft 31. A belt transmission mechanism 33 is provided between the drive shaft 32*a* and the support shaft 31 so that, as the motor 32 is driven, the rotary cutter 30 is rotated by the belt transmission mechanism 33.

When the rotary cutter 30 is activated for a cutting operation, the cutter 30 is moved to a cutting position, which is lower than the position shown in FIG. 2(*a*). A standby position is located above the position shown in FIG. 2A. When the filament winding apparatus 1 is not in use, the rotary cutter 30 is located at a position to the right of the standby position in FIG. 2(*a*).

A description will now be given of a method of producing a cylinder (e.g., the shaft body of a drive shaft) by using the filament winding apparatus 1 having the above-described structure. In FIGS. 5(*a*) to 5(*d*), FIGS. 6(*a*) to 6(*d*) and FIGS. 7(*a*) to 7(*d*), hatching indicating cross sections has been omitted.

First, the mandrel M is placed between the first chuck 2 and the rotary shaft 5. Then, the right end Ms of the mandrel M is inserted into the hole 6*a*, and the rotary shaft 5 and the mandrel M are coupled with the coupling pin 8. Then, the ring 21 and the yarn engagement rings 22 are secured at predetermined positions.

As shown in FIG. 4, the yarn guide 4 is placed near the fixed holding member 13*a*, the movable holding member 13*b* is placed at the release position, and the end of the yarn Y that is connected to the yarn guide 4 is put around the rotary shaft 5 in the vicinity of the fixed holding member 13*a*. Next, the air cylinder 14 is extended to move the movable holding member 13*b* to the holding position and to shift the yarn guide 4 to an original position. This brings the filament winding apparatus 1 to the ready state of FIG. 5A.

Next, the filament winding apparatus 1 is activated, and the chucks 2 and 3 rotate the mandrel M and the yarn guide 4 is shifted toward the mandrel M from the original position. Then, the yarn Y, which has been fed from the yarn feeding section and has been impregnated with a resin in the resin tank, is wound around the mandrel M. In this embodiment, the resin in use is a thermosetting resin (e.g., epoxy resin) and the yarn Y in use is roving of carbon fibers.

The yarn Y is wound around the mandrel M such that the end is wound in a lap winding first. Then, winding is carried out so that the angle to the axial direction of the mandrel M (winding angle) is a predetermined angle that is smaller than the winding angle of the end winding. When the end winding is performed, the yarn Y that is held by the holding device 13 and connected to the yarn guide 4 is engaged with the yarn engagement section 19 and the pins P of the mandrel M, so that it is stretched as shown in FIG. 5(*b*).

Next, the motor 32 is driven to rotate the rotary cutter 30, and the air cylinder 27 is extended to move the rotary cutter 30 to the cutting position, where the periphery of the cutter 30 comes between the yarn engagement rings 22 as shown in FIG. 5(*c*). After the rotary cutter 30 is shifted to the position where its periphery contacts the ring 21, the rotary cutter 30 is shifted to the standby position. Consequently, the yarn Y is cut between the yarn engagement rings 22.

After the upward movement of the rotary cutter 30 starts, the air cylinder 14 is actuated to move the movable holding member 13*b* to the release position, as shown in FIG. 5(*d*). In this state, the end face of the movable holding member 13*b* contacts the rotation transmitting section 11 and rotates with the rotation transmitting section 11. Then, the fixed holding member 13*a*, together with the support 9, rotates with the rotary shaft 5 because of the engagement members 17 and the grooves 12.

Figure 6A:
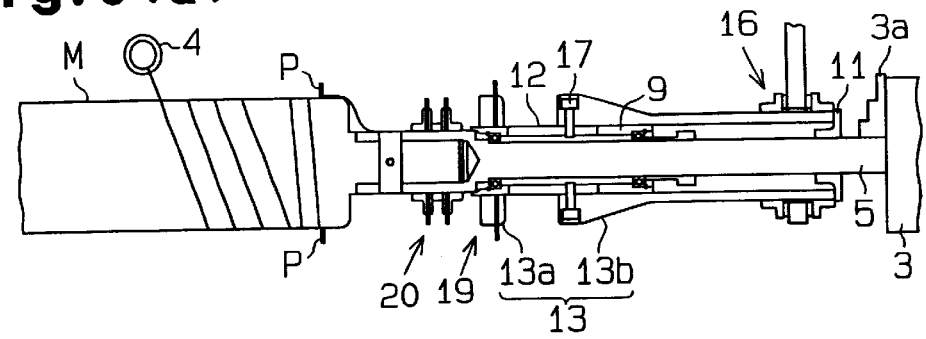
FIGS. 6(*a*) through 6(*d*) are exemplary diagrams for illustrating the operation of the filament winding apparatus.
Figure 6B:
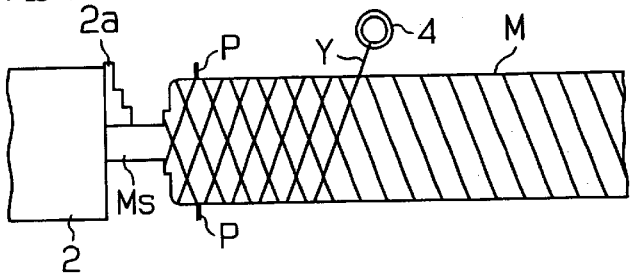
Figure 6C:
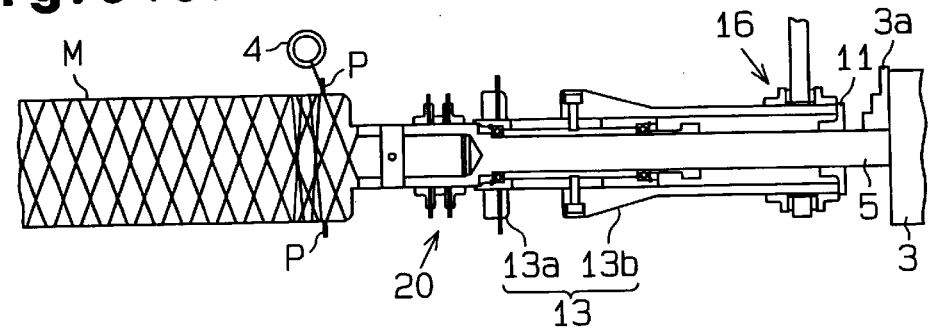
Figure 6D:
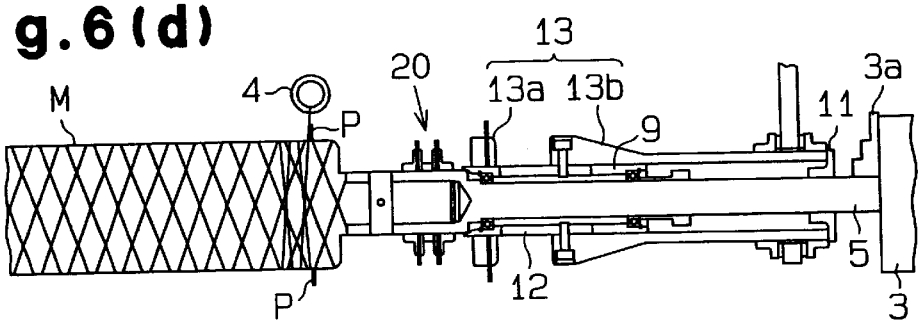
Figure 7A:
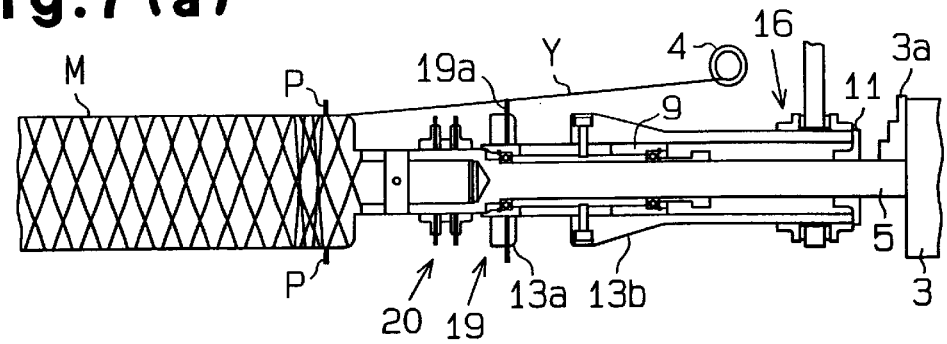
FIGS. 7(*a*) through 7(*d*) are exemplary diagrams for illustrating the operation of the filament winding apparatus.
Figure 7B:
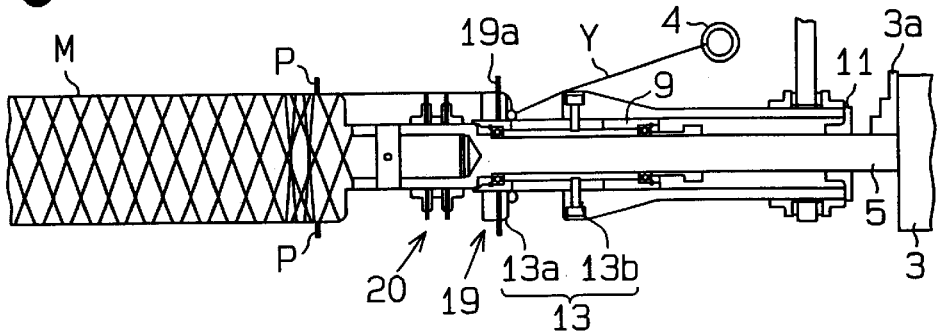
Figure 7C:
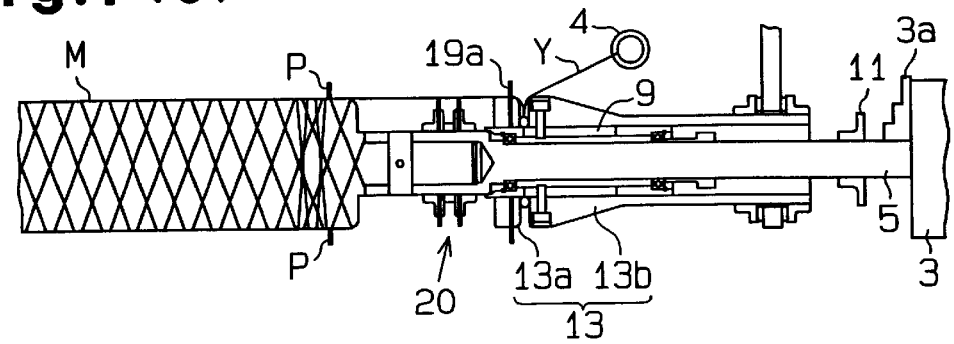
Figure 7D:
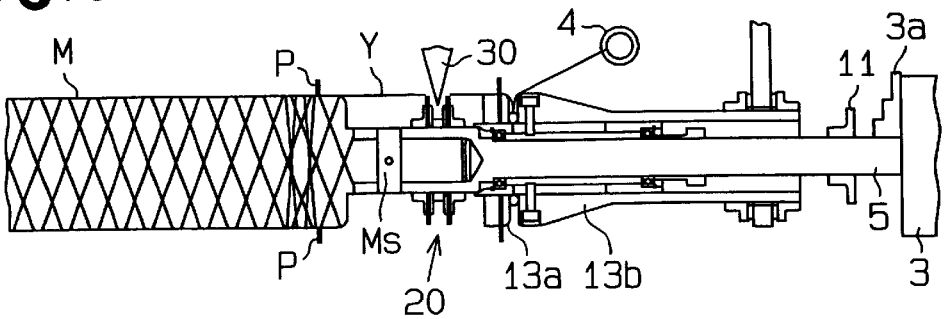
Figure 8A:
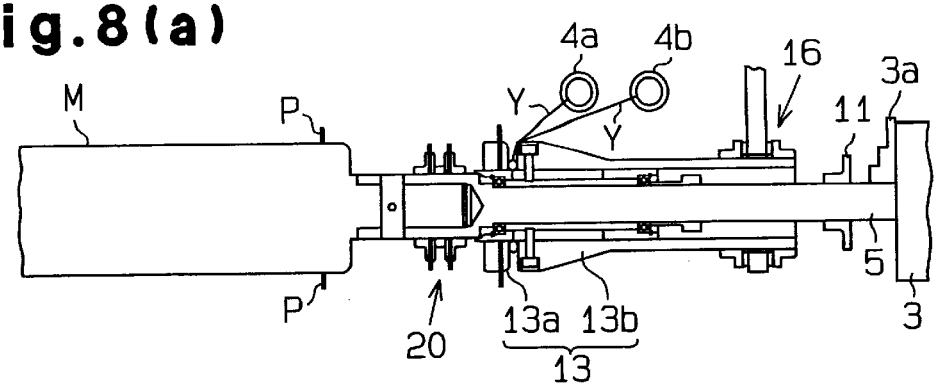
FIGS. 8(*a*) through 8(*d*) are exemplary diagrams for illustrating the operation of a filament winding apparatus according to a second embodiment of the present invention.
Figure 8B:
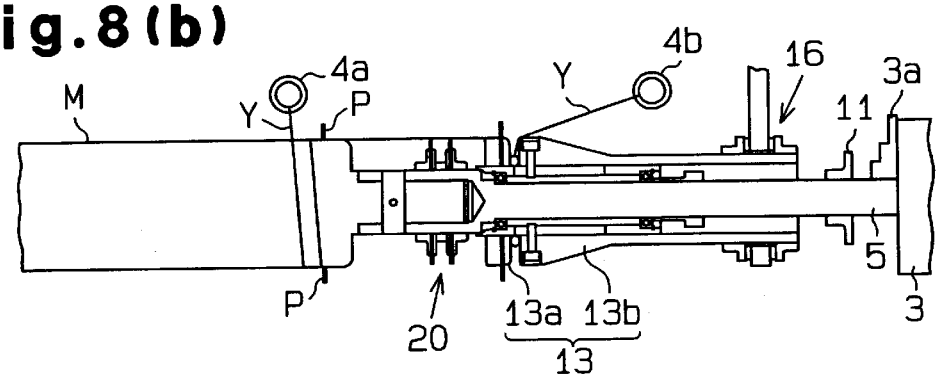
Figure 8C:
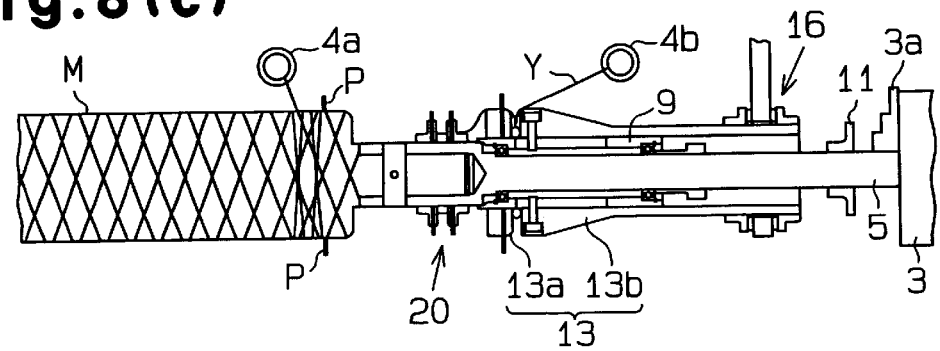
Figure 8D:
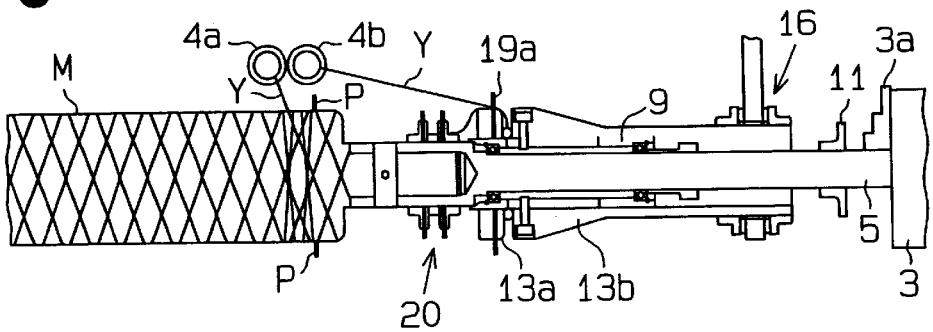
Figure 9A:
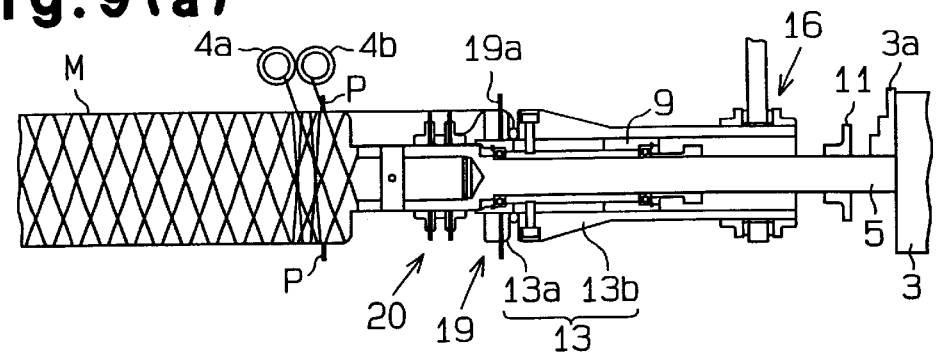
FIGS. 9(*a*) through 9(*d*) are exemplary diagrams for illustrating the operation of the apparatus of the second embodiment.
Figure 9B:
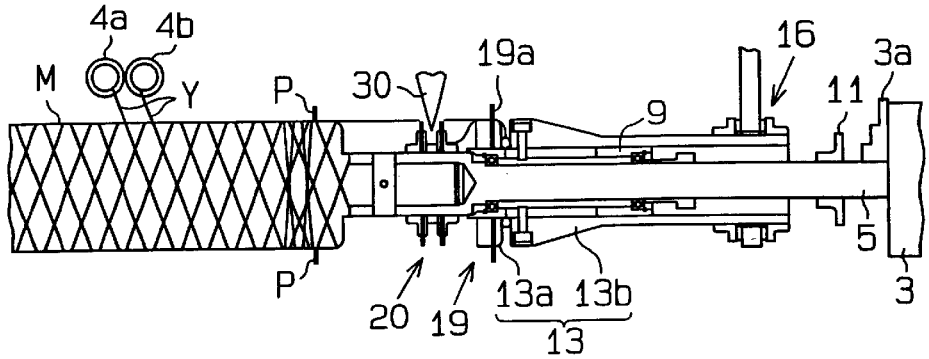
Figure 9C:
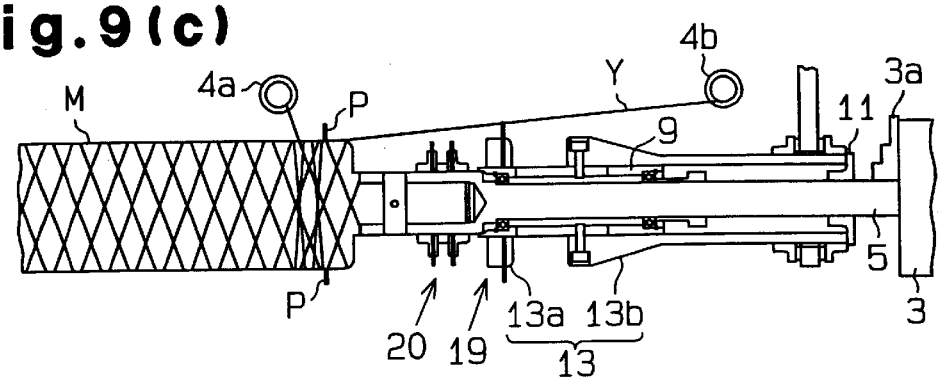
Figure 9D:
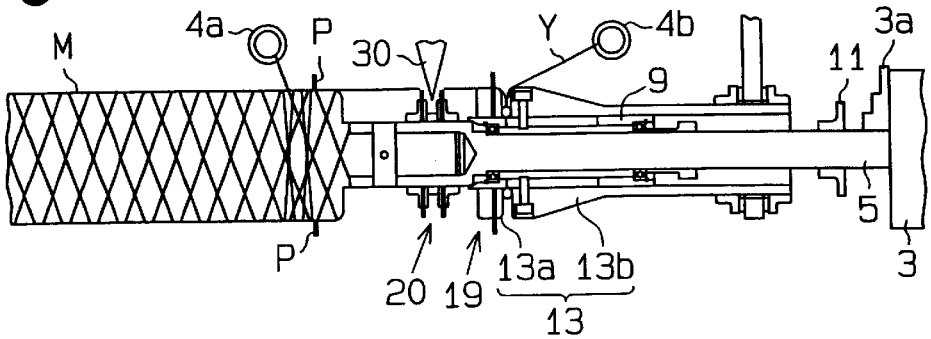

Then, the end of the released yarn Y is removed from the holder 13 by an unillustrated removing apparatus. The removing apparatus has a suction nozzle or an injection nozzle which injects compressed air, and a scraping device, such as a brush or scraper. The yarn Y, which adheres to the fixed holding member 13*a* or the movable holding member 13*b* is removed by the scraping device and is drawn into the suction nozzle or blown away by the injection nozzle. The resultant state is shown in FIG. 6A.

While the released end of the yarn Y is being removed, the yarn guide 4 continues moving (forward) to the left in FIG. 5(*d*). The yarn guide 4 is reversed at the left end of the mandrel M, and the yarn Y is wound with a winding angle opposite to the winding angle of the forward movement of the yarn guide 4, i.e., the yarn Y is wound symmetrically to a plane that is perpendicular to the axis of the mandrel M, as shown in FIG. 6(*b*). Thereafter, the yarn guide 4 is moved back and forth along the mandrel M by the number of times needed to form a filament layer having desired properties such as thickness.

After the filament layer of a predetermined thickness is formed, the yarn guide 4 is reversed at the right end of the mandrel M, as shown in FIG. 6(*c*), and end winding is performed as shown in FIG. 6(*d*). After end winding is completed, the yarn guide 4 is moved to the position corresponding to the movable holding member 13*b*, to the right of the yarn engagement section 19, as shown in FIG. 7(*a*). During this movement, the yarn Y extending between the yarn guide 4 and the mandrel M engages the pins 19*a* of the yarn engagement section 19 and is guided to the released holding device 13 and is wound on the support 9 as shown in FIG. 7(*b*). Then, as shown in FIG. 7(*c*), the movable holding member 13*b* is shifted to the holding position, and the yarn Y is reliably held by the holding device 13. Then, the yarn guide 4 is moved to the original position. Then, the rotary cutter 30 is moved to the cutting position to cut the yarn Y, as shown in FIG. 7(*d*). This completes the winding of the yarn Y.

Next, the mandrel M is removed from the first chuck 2, and the rotary shaft 5 and the pins P are disengaged from the mandrel M. The mandrel M is placed, together with the filament layer, into a heating furnace. The resin is cured at a predetermined temperature, thereby forming a cylinder (pipe or tube) of FRP on the mandrel M. After the FRP pipe cools, the ends of the FRP pipe are cut at positions inward of the former positions of the pins P. The FRP pipe is separated from the mandrel M, thus providing the body of a drive shaft that has a predetermined length.

The process has the following advantages.

(1) The beginning and the end of winding is carried out with the help of the holding device 13, which rotates with the rotary shaft 5, and the cutting device 24, which cuts the yarn Y extending from the holding device 13 to the mandrel M. It is therefore possible to fix the starting end and finishing end of a filament to the mandrel M with the same mechanism, without the risk of adding foreign matter such as adhesive tape, to the final product.

(2) The movable holding member 13*b* is moved along the rotary shaft 5 between the holding position and the release position and rotates together with the rotary shaft 5 at the release position because of the rotation transmitting section 11. This causes the yarn engagement section 19, which is connected to the fixed holding member 13*a*, to rotate. Thus, the structure that rotates the yarn engagement section 19 to guide the yarn Y to the holding position of the released holding device 13 is relatively simple.

(3) The cutting device 24 includes the rotary cutter 30, which is moved between the yarn engagement rings 22 of the cut aiding section 20 to cut the yarn Y. This permits the yarn Y to be cut without sliding. As the rotary cutter 30 is moved down to the position where it contacts the resin ring 21, the yarn Y is cut reliably.

(4) The rotary shaft 5, to which the holding device 13 and the cut aiding section 20 are mounted, is secured to the second chuck 3 of the filament winding apparatus 1. The filament winding apparatus of the invention is therefore a relatively simple modification of a conventional filament winding apparatus.

(5) The pins P are circumferentially located at predetermined locations on both ends of the body Ma of the mandrel M. Even if the winding angle of the yarn Y is small, therefore, the yarn Y is wound at a predetermined winding angle without sliding.

(6) Because the cutting device 24 is movable to a position different from the standby position above the cutting position, the cutting device 24 does not interfere with the work of removing the mandrel M and the preparation work.

Figure 10A:
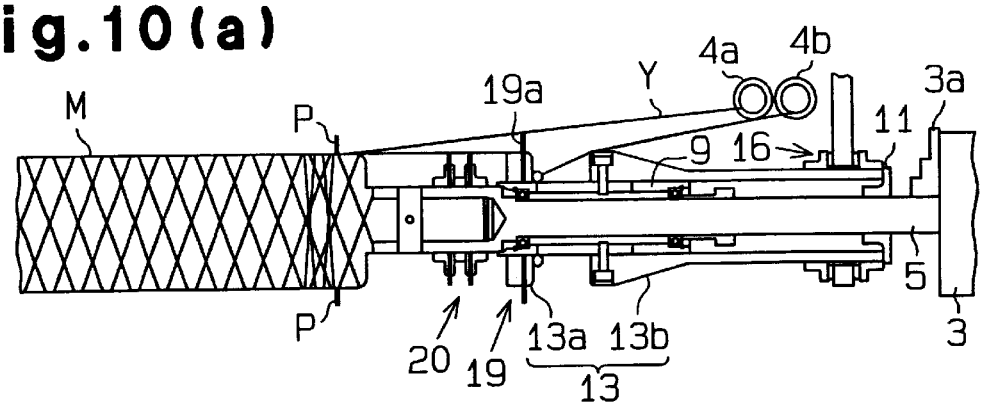
FIGS. 10(*a*) and 10(*b*) are exemplary diagrams for illustrating the operation of the apparatus of the second embodiment.
Figure 10B:
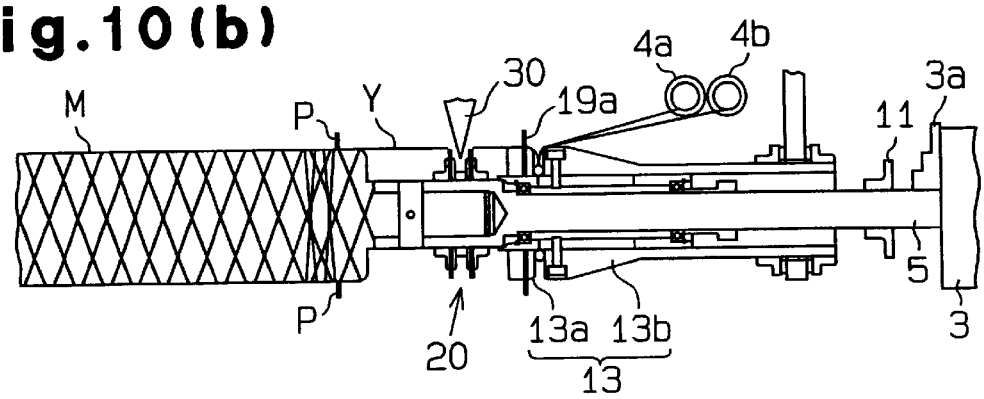

The second embodiment of the invention will now be discussed with reference to FIGS. 8 through 10. The method and apparatus of the second embodiment differ from those of the first embodiment in that, in the second embodiment, a plurality of yarn guides (two in this embodiment; 4*a* and 4*b*) are provided, and a mode of winding the yarn Y by one yarn guide 4*a* or a mode of winding the yarn Y using plural yarn guides 4*a* and 4*b* at the same time can be selected. Otherwise, the method and apparatus of the second embodiment is basically the same as those of the first embodiment. To avoid redundancy, therefore, same numerals are given to those components that are the same as the corresponding components of the first embodiment.

The two yarn guides 4*a* and 4*b* are designed to be independently movable back and forth in the axial direction of the mandrel M. A description will now be given of a method of manufacturing an FRP product that has an intermediate layer comprised of a greater number of yarns Y than the other layers.

Prior to the winding of the yarn Y, preparations are performed such as holding the end portions of the yarns Y from the yarn guides 4*a* and 4*b* with the holding device 13 to provide the state shown in FIG. 8(*a*). Next, the filament winding apparatus 1 is driven to rotate the chucks 2 and 3 and initiate the movement of the first yarn guide 4*a*. Then, the yarn Y is wound around the end portion of the mandrel M as shown in FIG. 8(*b*). Then, the first yarn guide 4*a* is moved back and forth a predetermined number of times as in the first embodiment, thus yielding a filament layer that has a predetermined thickness. During that time, the yarn Y extending between the holding device 13 and the mandrel M is cut as in the first embodiment.

When winding the yarn Y by the first yarn guide 4*a* is finished, the first yarn guide 4*a* stands by at the right-hand end of the mandrel M as shown in FIG. 8(*c*). Next, the second yarn guide 4*b* starts moving and comes close to the first yarn guide 4*a*, at the left hand side of the pins P of the mandrel M as shown in FIG. 8(*d*). In this state, end winding is carried out as shown in FIG. 9(*a*), after which the winding of the yarns Y with the first and second yarn guides 4*a* and 4*b* starts and the yarns Y extending to the holding device 13 from the mandrel M are cut, as shown in FIG. 9(*b*).

Then, winding of the yarns Y with both yarn guides 4*a* and 4*b* continues, and the movable holding member 13*b* is moved to the release position. When a predetermined amount of yarn Y is wound, end winding is performed at the right-hand end of the mandrel M, after which the second yarn guide 4*b* is moved to a location above the movable holding member 13*b*, as shown in FIG. 9(*c*). The yarn Y extending between the second yarn guide 4*b* and the mandrel M is led between the fixed holding member 13*a* and the movable holding member 13*b* and wound on the support 9. Next, the movable holding member 13*b* is moved to the holding position, and the second yarn guide 4*b* is moved to the original position, as shown in FIG. 9(*d*) as is the first embodiment. Then, the rotary cutter 30 cuts the yarn Y.

Next, the yarn Y is wound with only the first yarn guide 4*a*. After a predetermined amount of yarn Y is wound, end winding is carried out at the right-hand end of the mandrel M. Then, the movable holding member 13*b* is moved to the release position and the first yarn guide 4*a* is moved above the movable holding member 13*b* as shown in FIG. 10(*a*). Then, the yarn Y that extends to the first yarn guide 4*a* is led between the holding members 13*a* and 13*b* and wound on the support 9, the movable holding member 13*b* is moved to the holding position, and the yarn Y that extends to the mandrel M is cut by the rotary cutter 30 as shown in FIG. 10(*b*). This completes the winding steps.

This embodiment has the following advantages in addition to the advantages (1) to (6) of the first embodiment.

(7) Since the filament winding apparatus has plural yarn guides 4*a* and 4*b* that can be moved back and forth independently, an FRP pipe that has a specific layer having an increased number of yarns Y can be formed easily by simultaneously combining the winding of the yarn Y with plural yarn guides 4*a* and 4*b*.

(8) FRP pipes having different properties can be produced easily by changing the types of the yarns Y that are to be fed from the yarn guides 4*a* and 4*b*.

(9) By increasing the number of yarn guides 4 to three or more, an FRP pipe using three or more kinds of yarns Y can be manufactured.

Figure 12:
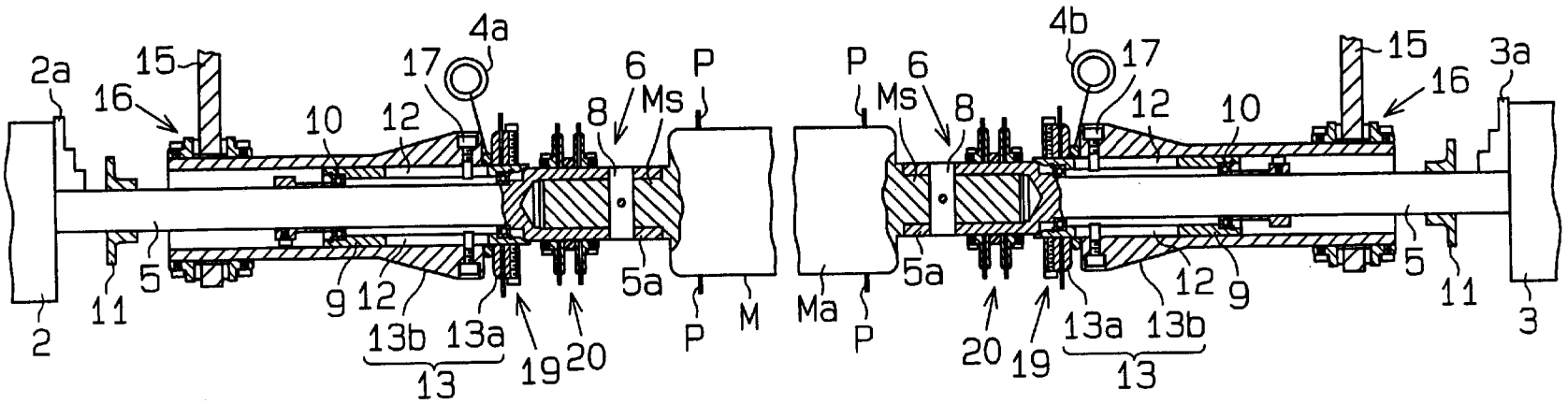
FIG. 12 is an exemplary cross-sectional view of a filament winding apparatus according to a third embodiment of the present invention.

The third embodiment of the present invention will be discussed below referring to FIG. 12. The third embodiment significantly differs from the first and second embodiments in that an end processing apparatus is provided at each end of the mandrel support, and yarn guides are provided in association with each end processing apparatus. The remaining structure of the third embodiment is the same as the corresponding structure of the first embodiment.

When the yarn Y is wound using only the first yarn guide 4*a*, the apparatus of the third embodiment has the same advantages as the advantages (1) to (6) of the first embodiment. Combining the winding of the yarn Y using both yarn guides 4*a* and 4*b* provides the advantages (7) and (8) of the second embodiment. Further, using three or more yarn guides provides the advantage (9) of the second embodiment. In addition, the third embodiment has the following advantage.

(10) Since an end processing apparatus is provided at each end of the mandrel support, yarn end processing can be performed on either end, right or left, of the mandrel M. Unlike the first and second embodiments, the third embodiment can provide an odd number of filament layers that are constructed by winding the yarns Y on the mandrel M. This embodiment is therefore advantageous, for example, when one wants to form a single layer of a different type of yarn as the outermost layer.

The invention is not limited to the above-described embodiments, but may be embodied in the following forms.

Figure 11A:
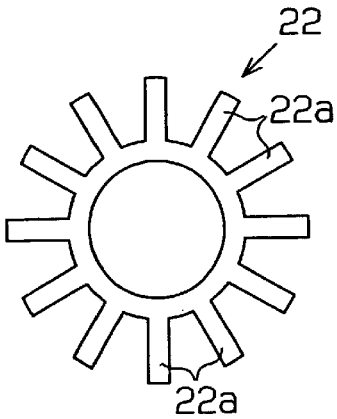
FIG. 11(*a*) is a side view of a yarn engagement ring according to one modification of the present invention.
Figure 11B:
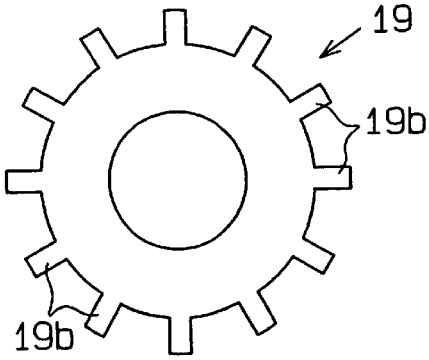

Each yarn engagement ring 22 may be constructed as a ring integrated with multiple engagement sections 22*a* as shown in FIG. 11(*a*). As shown in FIG. 11(*b*), the yarn engagement section 19 may be constructed as a ring integrated with multiple engagement sections 19*b*. This reduces the number of parts as compared with the embodiments that require multiple pins, which contributes to a reduction in manufacturing cost.

The pair of yarn engagement rings 22 and the ring 21 that constitute the cut aiding section 20 may be integrally formed of resin. This modification further reduces the number of components and the number of assembling steps.

When the movable holding member 13*b* is placed at the release position, the movable holding member 13*b* always abuts against the rotation transmitting section 11 and rotates with the section 11. The structure may be modified such that the movable holding member 13*b* is held at a position where it does not engage with the rotation transmitting section 11 in the normal release state, but the movable holding member 13*b* is moved to a position where it abuts against the rotation transmitting section 11 when yarn end processing is carried out to finish the winding of the yarn Y. Modifying the apparatus of the first embodiment in this way can save the energy lost when rotating the holding device 13 while winding the yarn Y by cutting the yarn Y extending to the mandrel M from the holding device 13 immediately after the winding of the yarn Y by the yarn guide 4 starts.

The cutting device 24 is not limited to that illustrated, but may be modified to have two blades, in the manner of scissors.

The cut aiding section 20 is not essential and can be omitted. In the case of the scissor type cutting device, omitting the cut aiding section 20 raises no significant problems.

In the case where a filament winding apparatus that is initially equipped with an end processing apparatus is to be manufactured, the holding device 13, the cut aiding section 20, etc. must be provided on the rotary shaft that is provided with the chucks, instead of later fixing the rotary shaft 5 of the end processing apparatus to the chucks 2 and 3 of the filament winding apparatus 1.

Although the illustrated apparatus is for producing vehicle propeller shafts, the filament winding apparatus may be adapted to manufacture pipes for other types of drive shafts.

The winding that prevents unwinding of the yarn even if the yarn is cut at the section that extends to the holding device from the mandrel is not limited to an end winding that laps the end. For example, the end winding may be omitted, and, instead, the yarn Y may be wound at one end of the body Ma of the mandrel M at a predetermined winding angle and turned back at the other end of the body Ma to resume the course. According to this modification, after an upper layer of yarn Y is wound, with a different winding angle, on the yarn Y that has been wound on the end of the body Ma where winding was started, cutting the yarn Y at a yarn section that extends to the holding device 13 from the mandrel M prevents unraveling of the end of the yarn Y and secures the yarn to the mandrel M. In the case where winding the yarn Y takes place without winding the end of the yarn Y at the end where winding was started, it is possible to reduce the difference between the thickness of the end of the pipe and the middle of the pipe. When producing a pipe with a thick end, it is preferred to perform the end winding.

The filament winding apparatus may be used to produce not only pipes but also cylindrical pressure containers that have hemispherical ends and are used to retain various kinds of high-pressure gases or compressed fluids. In this case, the base member of a liner (hollow body), which serves as a yarn winding member and replaces the mandrel, is supported between the chuck 2 and the rotary shaft 5 directly or with a bearing fixed to the base member. The yarn Y is wound around the liner. This modification permits the filament ends to be fixed to the liner with the same mechanism, without the risk of mixing foreign matter, such as adhesive tape, in the final product. Further, it is possible to change the number and types of yarns during winding.

The type of the yarn Y and the type of the impregnated resin in the yarn may be changed to other than the combination of carbon fibers and epoxy resin in accordance with the required performance of a product. To form a propeller shaft, however, the combination of carbon fibers and epoxy resin is preferable from the viewpoint of cost and performance.

Of the pins P that protrude from the end portions of the mandrel M, the pins P on the end that is opposite to the end corresponding to the end processing apparatus may not be needed when the winding angle is relatively large. Those pins P may be omitted even when the winding angle is small if the mandrel is designed to have hemispherical ends.

It should be apparent to those skilled in the art that the present invention may be embodied in many other specific forms without departing from the spirit or scope of the invention. Particularly, it should be understood that the invention may be embodied in the following forms.

Therefore, the present examples and embodiments are to be considered as illustrative and not restrictive and the invention is not to be limited to the details given herein, but may be modified within the scope and equivalence of the appended claims.

What is claimed is:

1. An end processing method for winding a yarn impregnated with resin around the surface of a winding member with a guide member that moves back and forth in an axial direction of the winding member while supporting and rotating the winding member, the method comprising:

holding a first end of the yarn with a holding device;

initiating yarn winding at a first end of the winding member while the first end of the yarn is held by the holding device;

cutting the yarn between the winding member and the holding device;

releasing the yarn from the holding device before the winding is finished; and when winding of the yarn around the winding member is finished, winding the yarn at the first end of the winding member;

holding the yarn with the holding device; and cutting the yarn between the winding member and the holding device.

2. A yarn end processing apparatus for a filament winding apparatus comprising:

a rotary shaft for supporting a winding member;

a holding device supported in a relatively rotatable manner on the rotary shaft, the holding device being rotatable together with the winding member while holding a yarn wound around the winding member;

a yarn engagement device provided closer to the winding member than a yarn holding position by the holding device; and a mechanism for rotating the yarn engagement section when the holding device set in a release position.

3. The apparatus according to claim 2, wherein the holding device comprises:

a cylindrical support supported on the rotary shaft via a bearing;

a fixed holding member fixed to the support;

a movable holding member supported to move in an axial direction of the support and movable to a holding position, at which the movable holding member, together with the fixed holding member, holds the yarn and to move to a release position which is axially spaced from the holding position in a direction away from the winding member;

an engagement member fixed to the movable holding member for engaging an axial groove formed in the support; and a rotation transmitting section fixed on the rotary shaft;

wherein the movable member rotates together with the rotary shaft via the rotation transmitting section when the movable holding member is arranged at the release position.

4. The apparatus according to claim 2, further comprising a cutting device that cuts the yarn between the winding member and the holding device after initiating yarn winding, wherein the cutting device includes a rotary cutter, and the rotary shaft has a cut aiding device located between the yarn engagement section and the winding member for restricting movement of the yarn when cutting the yarn with the rotary cutter.

5. The apparatus according to claim 4, wherein the cut aiding section has a pair of rings having multiple engagement portions protruding radially, and a yarn is cut as the rotary cutter enters between the rings.

6. The apparatus according to claim 2, wherein the rotary shaft has a first end that is held by a chuck of the filament winding apparatus and a second end provided with a coupler for coupling the second end to a portion of the winding member.

7. The apparatus according to claim 2, wherein a plurality of guide members that are independently movable are provided, wherein each guide member is movable along an axial direction of the winding member and guides the yarn to be wound around the winding member.

8. A filament winding apparatus having an end processing apparatus, the end processing apparatus comprising:

a rotary shaft for supporting a winding member;

a holding device supported in a relatively rotatable manner on the rotary shaft, the holding device being rotatable together with the winding member while holding a yarn wound around the winding member;

a yarn engagement device provided closer to the winding member than a yarn holding position by the holding device; and a mechanism for rotating the yarn engagement section when the holding device is set in a release position;

wherein the end processing apparatus is a first end winding apparatus, and the filament winding apparatus further includes a second end processing apparatus, which has substantially the same structure as the first end processing apparatus, and is located at an opposite end of the winding member.

* * * * *